US007783238B2

(12) United States Patent
Oki et al.

(10) Patent No.: US 7,783,238 B2
(45) Date of Patent: Aug. 24, 2010

(54) TRANSFER CHARGER AND IMAGE FORMING APPARATUS

(75) Inventors: Yoshio Oki, Mie (JP); Daichi Ito, Mie (JP); Satoru Fukuzawa, Mie (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 12/569,729

(22) Filed: Sep. 29, 2009

(65) Prior Publication Data

US 2010/0080632 A1 Apr. 1, 2010

(30) Foreign Application Priority Data

Sep. 30, 2008 (JP) ..... 2008-253947
Sep. 25, 2009 (JP) ..... 2009-220699

(51) Int. Cl.
*G03G 15/20* (2006.01)
*G03G 15/01* (2006.01)
*G03G 15/08* (2006.01)

(52) U.S. Cl. ..... 399/308; 399/121; 399/302; 399/310

(58) Field of Classification Search ..... 399/121, 399/297–299, 302, 303, 308, 310, 313, 314
See application file for complete search history.

(56) References Cited

U.S. PATENT DOCUMENTS 5,918,096 A * 6/1999 Sano et al. ..... 399/314
5,923,935 A * 7/1999 Yamaguchi ..... 399/297
6,496,679 B2 * 12/2002 Kitahara ..... 399/310
2002/0094217 A1 * 7/2002 Miyamoto et al. ..... 399/299
2009/0196663 A1 * 8/2009 Yasumaru et al. ..... 399/308

FOREIGN PATENT DOCUMENTS

JP 09-120218 A 5/1997
JP 2007-041242 A 2/2007
JP 2007-156455 A1 6/2007

* cited by examiner

*Primary Examiner*—David M Gray
*Assistant Examiner*—Joseph S Wong
(74) *Attorney, Agent, or Firm*—Hedman & Costigan, P.C.; James V. Costigan

(57) ABSTRACT

The present invention provides a transfer charger which provides an intermediate transfer belt with a sufficient transfer efficiency, does not wear in contact with an inner surface of the intermediate transfer belt, has a low frictional property, and is excellent in its friction stability and an image-forming apparatus. A transfer charger (62) is mounted inside the image-forming apparatus where a toner image held on an image holder (12) is transferred to an intermediate transfer belt (31) to obtain an image. The transfer charger (62) makes a surface contact with an inner surface of the intermediate transfer belt (31), with the transfer charger (62) being pressed toward the image holder (12) owing to a pressing member (61). The transfer charger (62) is a sheet material consisting of a resin composition containing 100 parts by weight of non-injection-moldable ultra-high-molecular-weight polyethylene resin, 2 to 15 parts by weight of electrically conductive carbon, and 0.5 to 5 parts by weight of at least one powder selected from among PTFE resin powder, graphite powder, and silicone resin powder.

16 Claims, 4 Drawing Sheets

TRANSFER CHARGER AND IMAGE FORMING APPARATUS

BACKGROUND OF THE INVENTION

1. Field of the Invention

The present invention relates to a transfer charger transferring a toner image held by an image holder to an intermediate transfer belt and an image-forming apparatus.

2. Description of the Related Art

The image-forming apparatus is known in which a toner image held by the image holder is transferred to the intermediate transfer belt to obtain an image. The image-forming apparatus adopts a method of transferring the toner image held by the image holder to the intermediate transfer belt nipped by the image holder and a transfer roller.

There is formed a portion where the intermediate transfer belt and the transfer roller confront each other with a small gap interposed therebetween in the neighborhood of a portion where the intermediate transfer belt and the transfer roller contact each other. A transfer electric field having an unclear boundary is formed in the portion where the small gap is formed. Such an unclear transfer electric field can be a factor deteriorating transfer performance. For example, such an unclear transfer electric field causes the toner image to be scattered upstream from a transfer region. A transfer blade which contacts an inner surface of the intermediate transfer belt opposite to the transfer surface thereof to which the toner image is transferred is known (see patent document 1). The portion of the transfer blade where it confronts the intermediate transfer belt with the small gap interposed therebetween is very small. A small transfer electric field having the unclear boundary is formed in the gap formed between the transfer blade and the intermediate transfer belt unlike the above-described construction. Thus the above-described transfer performance little deteriorates. But there is a fear that the transfer efficiency deteriorates because an image-forming apparatus using the transfer blade has a narrow transfer region.

Instead of the transfer blade, the edge of which contacts the intermediate transfer belt, there is proposed the transfer member capable of making a surface contact with the intermediate transfer belt (see patent documents 2 and 3). The transfer member is rectangular solid-shaped. The material of the film which can be used for the surface of the transfer member which contacts the intermediate transfer belt is disclosed in the patent document 2.

But the transfer member disclosed in the patent document 2 makes the surface contact with the inner surface of the intermediate transfer belt in a large area. Thereby the transfer member has a large frictional resistance and contacts the intermediate transfer belt uncontinuously with the movement of the intermediate transfer belt. As a result, the generation of a transfer electric field may become unstable. Unless the frictional resistance of the transfer member is stable, an image deviation occurs. In some cases, there is a possibility that the transfer member is removed from a holder or broken.

Patent document 1: Japanese Patent Application Laid-Open No. 2007-41242

Patent document 2: Japanese Patent Application Laid-Open No. 09-120218

Patent document 3: Japanese Patent Application Laid-Open No. 2007-156455

BRIEF SUMMARY OF THE INVENTION

Problems to be solved by the Invention

The art disclosed in the patent document 3 has been developed to solve the above-described problems. The supporting member supporting the transfer member is capable of oscillating. Thus when a large frictional force is likely to be generated on the transfer member, the transfer member inclines toward the rotational direction of the intermediate transfer belt. Thereby the frictional force applied to the transfer member from the intermediate transfer belt is decreased. Therefore the transfer member is capable of stably contacting the intermediate transfer belt in the image-forming operation.

But a transfer member which is capable of securely providing a sufficient transfer efficiency for the intermediate transfer belt, does not wear in sliding contact with the inner surface of the intermediate transfer belt, has a low frictional property, and is excellent in its friction stability has not been developed.

The present invention has been made in view of the above-described problems. It is an object of the present invention to provide a transfer charger for producing a transfer member which provides an intermediate transfer belt with a sufficiently high transfer efficiency, does not wear in sliding contact with an inner surface of the intermediate transfer belt, has a low frictional property, and is excellent in its friction stability and an image-forming apparatus.

Means for Solving the Problems

The transfer charger of the present invention is mounted inside an image-forming apparatus where a toner image held on an image holder is transferred to an intermediate transfer belt to obtain an image. The transfer charger constructs a transfer member disposed on an inner surface of the intermediate transfer belt opposite to a transfer surface thereof to which the toner image is transferred. The transfer charger makes surface contact with the inner surface of the intermediate transfer belt and is pressed toward the image holder owing to a pressing member.

The transfer charger is formed by molding a resin composition containing 100 parts by weight of non-injection-moldable ultra-high-molecular-weight polyethylene (hereinafter referred to as UHMW PE) resin, 2 to 15 parts by weight of electrically conductive carbon, and 0.5 to 5 parts by weight of at least one kind of powder selected from among polytetrafluoroethylene (hereinafter referred to as PTFE) resin powder, graphite powder, and silicone resin powder into a sheet material.

The non-injection-moldable UHMW PE resin is ultra-high-molecular-weight PE resin having a weight-average molecular weight of 1,000,000 to 4,000,000. Particles of the non-injection-moldable ultra-high-molecular-weight polyethylene resin are unspherical.

An average particle diameter of the non-injection-moldable UHMW PE resin is not less than three times as large as an average particle diameter of the electrically conductive carbon and an average particle diameter of each of the selected kinds of powder. An average particle diameter of the non-injection-moldable UHMW PE resin is 100 to 200 μm; an average particle diameter of the electrically conductive carbon is not more than 1 μm; and an average particle diameter of each of the selected kinds of powder is 1 to 30 μm.

The electrically conductive carbon to be used in the present invention is Ketjenblack. The primary particle diameter of the Ketjenblack is 30 to 38 nm. The Ketjenblack has a BET specific surface area of 1000 to 1500 $m^2/g$.

The polytetrafluoroethylene resin powder is modified polytetrafluoroethylene resin powder modified with alkyl vinyl ether. The graphite powder is artificial graphite containing not less than 98.5 wt % of fixed carbon. The silicone resin powder is spherical.

The transfer charger has a surface resistance value (JIS K7194) of $1.0\times10^2\Omega/\square$ to $1.0\times10^{12}\Omega/\square$. The transfer charger has a thickness of 0.04 mm to 1.0 mm.

The transfer charger contains the electrically conductive carbon and the selected kinds of powder disposed at a grain boundary of particles of the non-injection-moldable UHMW PE resin in a surface layer thereof.

The image-forming apparatus of the present invention has an image holder holding a toner image; an intermediate transfer belt moving in contact with the image holder; a transfer charger for transferring the toner image held on the image holder to a surface of the intermediate transfer belt; and a pressing member for bringing the transfer charger into contact with an inner surface of the intermediate transfer belt opposite to a transfer surface thereof to which the toner image is transferred and pressing the transfer charger toward the image holder. The transfer charger of the present invention is used for the image-forming apparatus. The pressing member consists of rubber, elastomer or sponge.

Effect of the Invention

The transfer charger of the present invention is the sheet material consisting of the resin composition containing 100 parts by weight of the non-injection-moldable UHMW PE resin, 2 to 15 parts by weight of the electrically conductive carbon, and 0.5 to 5 parts by weight of at least one powder selected from among the PTFE resin powder, the graphite powder, and the silicone resin powder. Therefore the transfer charger has a low and stable frictional resistance and is capable of stably contacting the inner surface of the intermediate transfer belt. Thereby the transfer charger has a uniform and stable surface resistance value and does not cause an image to be deviated.

Because the non-injection-moldable UHMW PE resin of the transfer charger has the molecular weight of 1,000,000 to 4,000,000, the transfer charger has low frictional property and wear-resistant property.

Because the particles of the non-injection-moldable UHMW PE resin is unspherical, particles thereof easily contact each other. Therefore the particles easily fuse each other in compression-molding the resin composition. Thereby the transfer charger has a high mechanical strength.

In the transfer charger of the present invention, because the average particle diameter of the non-injection-moldable UHMW PE resin is not less than three times as large as the average particle diameter of each of the other components, particles of the other components easily attach to the particles of the non-injection-moldable UHMW PE resin. Thus it is easy for the other components to display the characteristics thereof. Because the average particle diameter of the non-injection-moldable UHMW PE resin, that of the electrically conductive carbon, and that of each of the selected kinds of powder are 100 to 200 μm, not more than 1 μm; and 1 to 30 μm respectively, it is easy for the other components to display the characteristics thereof. Thus the transfer charger is excellent in the stability of its low frictional property and electrically conductivity.

Because the electrically conductive carbon to be used for the transfer charger is Ketjenblack, the transfer charger is excellent in the stability of its surface resistance value. Because the primary particle diameter of the Ketjenblack is 30 to 38 nm, the use of even a small amount thereof allows the transfer charger to have a desired surface resistance value. Further because the BET specific surface area of the Ketjenblack is 1000 to 1500 $m^2/g$, the use of even a small amount thereof allows the transfer charger to have an excellent stability in the surface resistance thereof.

In the transfer charger of the present invention, the polytetrafluoroethylene resin powder is modified polytetrafluoroethylene resin powder modified with alkyl vinyl ether. The graphite powder is artificial graphite containing not less than 98.5 wt % of fixed carbon. The silicone resin powder is spherical. Therefore the transfer charger is excellent in its frictional property without deteriorating its wear resistance.

The transfer charger of the present invention has the surface resistance value of $1.0\times10^2\Omega/\square$ to $1.0\times10^{12}\Omega/\square$, when the surface resistance value is measured in accordance with the method specified in JIS K7194. Thus a transfer bias can be applied to the intermediate transfer belt from a power source.

The transfer charger of the present invention has a sheet thickness of 0.04 mm to 1.0 mm. Therefore the transfer charger easily contacts the inner surface of the intermediate transfer belt.

The transfer charger contains the electrically conductive carbon and the selected kinds of powder disposed at a grain boundary of particles of the non-injection-moldable ultra-high-molecular-weight polyethylene resin in a surface layer thereof. Therefore the use of even a small amount thereof allows the transfer charger to be excellent in the stability of its surface resistance value.

Because the transfer charger of the present invention is used for the image-forming apparatus of the present invention, the frictional resistance between the intermediate transfer belt and the transfer charger is low and stable. Therefore no image deviation occurs in the image-forming apparatus.

In the image-forming apparatus, the pressing member consists of rubber, elastomer or sponge. Therefore it is easy to bring the transfer charger into contact with the inner surface of the intermediate transfer belt.

DETAILED DESCRIPTION OF THE INVENTION

Figure 1:
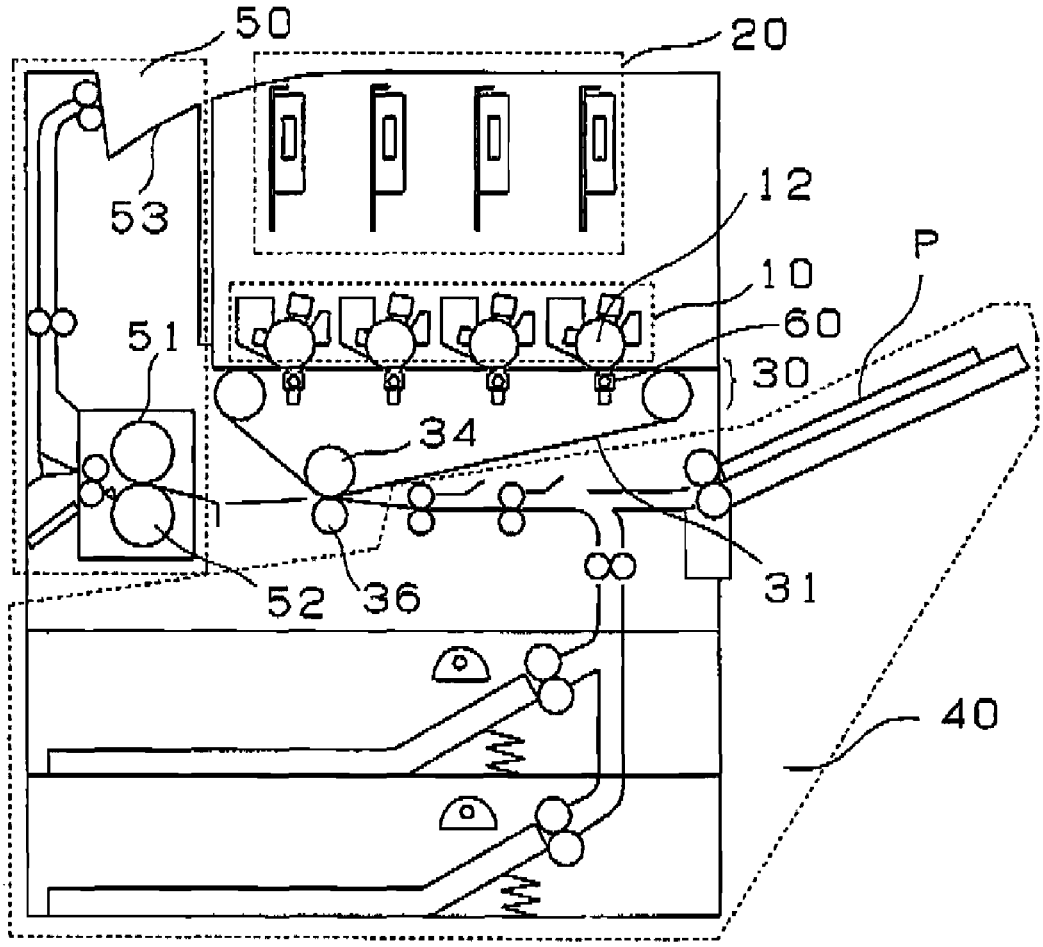
FIG. 1 shows an image-forming apparatus of the present invention.

One embodiment of an image-forming apparatus of the present invention is described below with reference to FIGS. 1 through 3. An image-forming apparatus shown in FIG. 1 is a color printer having four image-forming stations which form toner images of different colors. As shown in FIG. 1, the image-forming apparatus has process cartridges 10 which are removably mounted on the image-forming stations respectively and correspond to the colors respectively, an optical unit 20, an intermediate transfer unit 30, a recording material supply unit 40, and a fixing unit 50. The optical unit can be irradiated with laser beams corresponding to image information. The recording material supply unit 40 transports a recording material P from each feeding cassette to a secondary transfer region. The fixing unit 50 has a fixing roller 51 and a pressure roller 52, thus fixing the toner image to the recording material P by applying heat and pressure to the toner image disposed on the recording material P.

Figure 2:
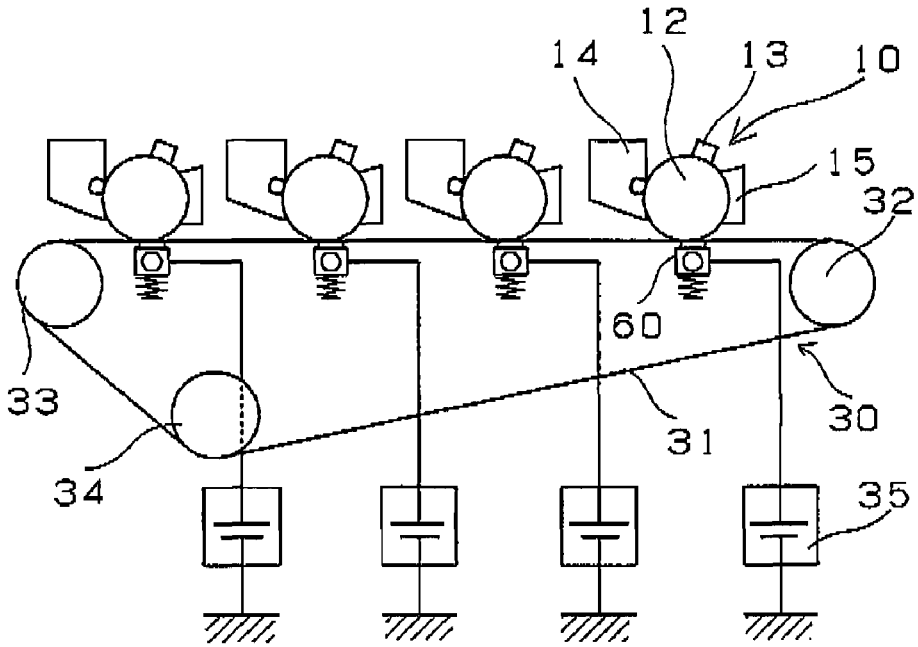
FIG. 2 shows an intermediate transfer unit of the image-forming apparatus of the present invention.

FIG. 2 enlargingly shows the peripheral portion of the process cartridges 10 and the intermediate transfer unit 30 shown in FIG. 1. As shown in FIG. 2, each process cartridge 10 has a photosensitive drum which is an electrophotographic photoreceptor (image holder), a charging means 13, a developing device 14, and a cleaning device 15.

The intermediate transfer unit 30 has an intermediate transfer belt 31 which is an endless belt and three rollers 32, 33, and 34 supporting the intermediate transfer belt 31 rotatably and movably. The intermediate transfer unit 30 has a primary transfer means 60 transferring the toner image formed on each photosensitive drum 12 to the intermediate transfer belt 31.

The intermediate transfer belt 31 moves between the photosensitive drum 12 and the primary transfer means 60. Each primary transfer means 60 sequentially transfers the toner images formed on respective photosensitive drums 12 in a secondary transfer region to the intermediate transfer belt 31 by overlapping the toner images one upon another.

The image-forming process to be performed in the image-forming apparatus having the above-described construction is described below with reference to FIGS. 1 and 2. In each process cartridge 10, the photosensitive drum 12 is uniformly charged by the charging means 13 (see FIG. 2). Thereafter axe electrostatic latent image is formed on the photosensitive drum 12 by laser beams emitted by the optical unit 20. Thereafter the electrostatic latent image is developed by a developing device 14 (see FIG. 2) to form the toner image.

The toner image formed on the photosensitive drum 12 is primarily transferred to the intermediate transfer belt 31 by the operation of the primary transfer means 60. Toner which has remained on the surface of the photosensitive drum 12 where the primary transfer has finished is cleaned by a cleaning device 15 (see FIG. 2). The toner images in the colors formed on the photosensitive drum are transferred to the intermediate transfer belt 31 by sequentially overlapping the toner images one upon another.

The recording material supply unit 40 transports the recording material P from the feeding cassette to the secondary transfer region. Owing to the operation of a secondary transfer roller 36, the toner image formed on the intermediate transfer belt 31 is transferred to the recording material P transported to the secondary transfer region. The recording material P to which the toner image has been transferred is transported to the fixing unit 50 where the toner image is fixed at a nipping portion of the fixing roller 51 and the pressure roller 52 and thereafter discharged to a discharge tray 53.

As shown in FIG. 2, the intermediate transfer belt 31 is tightened and rotated by driving rollers 32, 33, and 34 driven by a driving force transmitted thereto from a driving means. The photosensitive drum 12 of each process cartridge 10 is rotated at a peripheral speed almost equal to a rotation speed of the intermediate transfer belt 31.

The primary transfer means 60 serving as a transfer means is disposed on an inner surface of the intermediate transfer belt 31 opposite to a surface thereof to which the toner image has been transferred with the primary transfer means 60 confronting the photosensitive drum 12. The primary transfer means 60 is connected to a power source 35 which applies a transfer bias having a predetermined current value. The power source 35 supplies the transfer means 60 with electric current. Thereby the toner image formed on the photosensitive drum 12 confronting the primary transfer means 60 is electrostatically attracted to the intermediate transfer belt 31.

Figure 3:
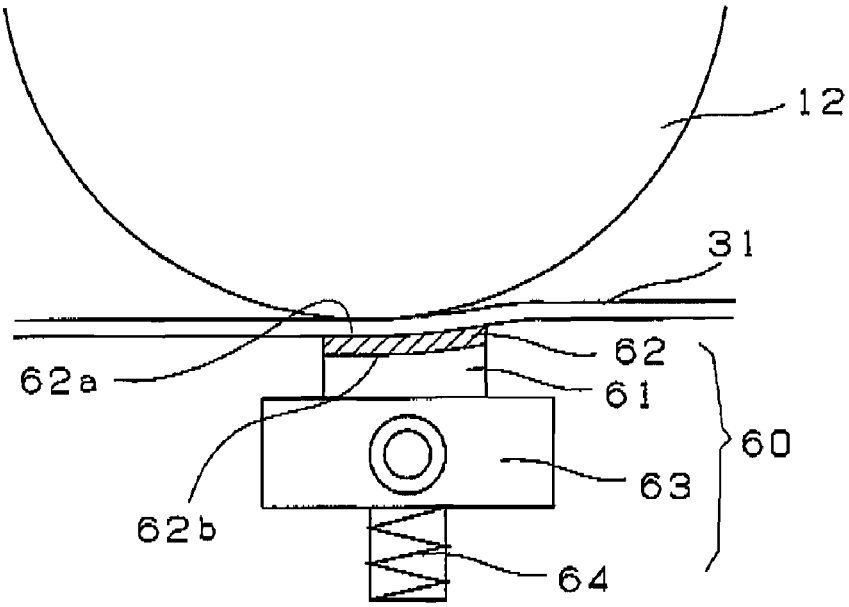
FIG. 3 shows a transfer charger of the present invention.

FIG. 3 enlargingly shows the periphery of the primary transfer means 60. The primary transfer means 60 has a pressing member 61 supported by a supporting member 63 and a transfer charger 62 bonded to the pressing member 61. The pressing member 61 which is an electrically conductive elastic body having the shape of a rectangular solid. A compression spring 64 presses the pressing member 61 against the inner surface of the intermediate transfer belt 31. The transfer charger 62 is formed by molding a resin composition into a sheet material. The transfer charger 62 contacts the inner surface of the intermediate transfer belt 31 at a contact surface 62*a* thereof. A bonding surface 62*b* of the transfer charger 62 is bonded to the pressing member 61.

When the intermediate transfer belt 31 moves (rotates), the transfer charger 62 and the intermediate transfer belt 31 slide on each other. The pressing member 61 is formed from any one of rubber, elastomer, and sponge. The pressing member 61 brings the transfer charger 62 into contact with the inner surface of the intermediate transfer belt 31 and elastically presses the transfer charger 62 toward the photosensitive drum 12.

The transfer charger 62 is the sheet material consisting of the resin composition containing non-injection-moldable UHMW PE resin to which electrically conductive carbon and at least one substance selected from among PTFE resin powder, graphite powder, and silicone resin powder are added. The electrically conductive carbon is a conductivity-imparting material for imparting electrically conductivity to the transfer charger 62. Each of the above-described powders is a lubricity-imparting material for imparting lubricity to the transfer charger 62. Because the transfer charger 62 is the sheet material consisting of the above-described resin composition, the transfer charger 62 is excellent in its electrically conductivity, frictional property, and torque stability. The details of the components composing the resin composition are described below.

The base resin of the resin composition to be used in the present invention is the non-injection-moldable UHMW PE resin. The UHMW PE resin is PE resin obtained by increasing the molecular weight of polyethylene, (hereinafter referred to as PE) up to 500,000 to 7,000,000 from 20,000 to 300,000 (normal molecular weight), which is crystalline thermoplastic resin obtained by polymerizing ethylene. The UHMW PE resin is unadhesive, has a low frictional property and a high insulating property, and is easily electrostatically charged. The UHMW PE resin having a molecular weight exceeding one million has a very high viscosity when it melts and hardly flows. Thus it is very difficult to mold such UHMW PE resin by a normal injection molding method. Therefore such UHMW PE resin is formed by compression molding or extrusion molding. The non-injection-moldable UHMW PE resin is superior to injection-moldable UHMW PE resin in the low friction property thereof and in the wear resistance thereof. Therefore the non-injection-moldable UHMW PE resin does not wear the intermediate transfer belt which is a mating material of the transfer charger 62 nor wears itself. Therefore the non-injection-moldable UHMW PE resin stably maintains its low frictional property and electrically conductivity with age. To form the sheet material from the non-injection-moldable UHMW PE resin, after the non-injection-moldable UHMW PE resin is molded cylindrically by compression molding, the molded article is skived.

It is preferable that the weight-average molecular weight of the non-injection-moldable UHMW PE resin to be used in the present invention is one million to four millions. By setting the weight-average molecular weight thereof to this range, the low frictional property and wear-resistant property of the non-injection-moldable UHMW PE resin are improved. As such non-injection-moldable UHMW PE resin, Hi-zex-million (weight-average molecular weight: 500,000 to 6,000,000) and Mipelon (weight-average molecular weight: 2,000,000) both produced by Mitsui Chemicals, Inc. are listed.

It is desirable that particles of the non-injection-moldable UHMW PE resin is unspherical. It is more desirable that the configurations of the particles are not particular but are different from one another. The particles of the UHMW PE resin having different configurations contact each other to a high extent in compression-molding the mixture of the particles of the UHMW PE resin and other components and the particles easily fuse each other. Therefore the molded article has a high mechanical strength including tensile strength and bending strength. Thereby the sheet material has an excellent wear resistance.

When the average diameter of the particles of the non-injection-moldable UHMW PE resin is not less than three times as large as the average diameter of particles of the other components, the particles of the other components are capable of entering between the particles of the UHMW PE resin, and the particles of the UHMW PE resin are capable of contacting one another. Thereby the mechanical strength and wear resistance of the sheet material do not deteriorate, but it is easy for the other components to display the characteristics thereof. It is preferable that the average particle diameter of the non-injection-moldable UHMW PE resin is in the range of 100 to 200 μm; the average particle diameter of the electrically conductive carbon is not more than 1 μm; and the average particle diameter of each of the three kinds of powder is in the range of 1 to 30 μm. In this range, the properties of the electrically conductive carbon and the three kinds of powder are favorably displayed. The average particle diameters are measured by the laser analysis method. As an apparatus for measuring particle size distribution by laser analysis, "Microtrac HRA" produced by Leeds & Northrup company can be used.

It is preferable that the surface resistance value (JIS K7194) of the transfer charger 62 consisting of the sheet material is $1.0\times10^{2}\Omega/\square$ to $1.0\times10^{12}\Omega/\square$. When the surface resistance value is larger than $1.0\times10^{12}\Omega/\square$, the transfer charger 62 is incapable of securely obtaining conductivity. Thereby the toner image is not transferred to the intermediate transfer belt. When the surface resistance value is smaller than $1.0\times10^{2}\Omega/\square$, there is a fear that bias leak (discharge) is generated. When the bias leak is generated, pinholes are formed on the surface of the photosensitive drum and that of the intermediate transfer belt. As a result, defective transfer occurs. Thereby an image quality deteriorates.

As the electrically conductive carbon serving as the electrically conductivity-imparting material, it is possible to use any of carbon fiber, carbon nanotubes, fullerene, and carbon powder. Of these electrically conductive carbons, the carbon powder is preferable because it does not have shape anisotropy and is excellent in its cost performance. As the carbon powder, carbon black can be used. By adopting the carbon black as the electrically conductive carbon, the use of even a small amount of the carbon black allows the sheet material to have a desired range in its surface resistance value. The merit to be obtained by adding a small amount of electrically conductive carbon to the base resin is that electrically conductive carbon can be uniformly dispersed in producing the sheet material. Thereby it is possible to restrain the low frictional property of the sheet material from becoming unstable.

It is possible to use the carbon black produced by any of the incomplete combustion methods including the decomposition method such as the thermal black method, the acetylene black method, the channel black method, the gas furnace black method, the oil furnace black method, the Pine carbon black method, the lamp black method. Furnace black, acetylene black, the Ketjenblack (registered trademark) are favorably used from the standpoint of electrically conductivity. Of these carbon blacks, the Ketjenblack is more favorable, because it is excellent in the electrically conductivity thereof.

It is particularly preferable to adopt the Ketjenblack having a primary particle diameter of 30 to 38 nm because the use of even a small amount thereof allows the sheet material to have a desired surface resistance value. It is preferable to adopt the Ketjenblack having the BET specific surface area of 1000 to 1500 $m^2/g$ because the use of even a small amount thereof allows the sheet material to have an excellent stability in the surface resistance value thereof. As such Ketjenblack, Ketjenblack EC-600JD produced by Ketjenblack International Inc. is exemplified.

It is preferable that the mixing amount of the electrically conductive carbon is 2 to 15 parts by weight for 100 parts by weight of the non-injection-moldable UHMW PE resin for the reason described below. When the mixing amount of the electrically conductive carbon black is smaller than two parts by weight, the surface resistance value of the sheet material is larger than $1.0\times10^{12}\Omega/\square$. Thereby the sheet material is incapable of securely obtaining electrically conductivity. When the mixing amount of the electrically conductive carbon black is larger than 15 parts by weight, the surface resistance value of the sheet material is smaller than $1.0\times10^{2}\Omega/\square$. Thereby there is a fear that the bias leak is generated and in addition the low frictional property of the sheet material and the wear resistance property thereof are adversely affected.

It is preferable that the surface resistance value of the pressing member 61 is $1.0\times10^{2}\Omega/\square$ to $1.0\times10^{12}\Omega/\square$ as in the case of the transfer charger. The pressing member 61 is made of any one of rubber, elastomer, and sponge. The electrically conductive carbon is added to the pressing member 61 as an electrically conductivity-imparting material. As the electrically conductive carbon, it is possible to adopt the carbon black for the above-described reason, for example, Ketjenblack having a primary particle diameter of 30 to 38 nm and the Ketjenblack having the BET specific surface area of 1000 to 1500 $m^2/g$.

The low frictional property of the sheet material is stabilized by adding at least one of the PTFE resin powder, the graphite powder, and the silicone resin powder serving as the lubricity-imparting material to the base resin. Owing to the addition of the lubricity-imparting material to the base resin, the electrically conductive carbon is uniformly dispersible at the interface of particles of the non-injection-moldable UHMW PE resin. The use of even a small amount of carbon allows the stability of the surface resistance value of the sheet material to be excellent.

It is possible to use the PTFE resin powder to be molded or for a solid lubricant. The PTFE resin powder modified with alkyl vinyl ether is preferable because it is capable of enhancing the wear resistance of the sheet material without deteriorating its low frictional property.

The graphite powder is classified into natural graphite and artificial graphite. The artificial graphite is unsuitable as the lubricant because the artificial graphite inhibits the lubricating performance owing to carborundum formed in a production process and in addition it is difficult to produce graphite having a sufficiently high graphitization. Because the natural graphite is produced in a completely graphitized state, it has a very high lubricating performance and hence suitable as the solid lubricant. But the natural graphite contains a large amount of impurities which deteriorate the lubricating performance. Thus it is necessary to remove the impurities, but difficult to completely remove them.

The preferable graphite powder to be used in the present invention is the artificial graphite containing not less than 98.5% of fixed carbon because the graphite powder is capable of improving the wear resistance of the sheet material, while it maintains the low frictional property thereof.

Because spherical silicone resin is excellent in the stability of the low frictional property of the sheet material, the spherical silicone resin powder can be preferably used. The silicone resin powder of the present invention consists of methyl silsesquioxane units and phenyl silsesquioxane units or the phenyl silsesquioxane units. One methyl silsesquioxane unit is shown by $(CH_3)SiO_{3/2}$. One phenyl silsesquioxane unit is shown by $(C_6H_5)SiO_{3/2}$. The silicone resin powder may contain a small amount of $(CH_3)_2(C_6H_5)SiO_{1/2}$, $(CH_3)_3SiO_{1/2}$, $(C_6H_5)_3SiO_{1/2}$, $(CH_3)_2(C_6H_5)_2SiO_{1/2}$, $(CH_3)_2SiO_{2/2}$, $(C_6H_5)_2\ SiO_{2/2}$, $(CH_3)(C_6H_5)SiO_{2/2}$, and $SiO_{4/2}$. The spherical silicone resin has a property of preventing the wear resistance of the sheet material from deteriorating. It is preferable to use the spherical silicone resin as the silicone resin powder because it is capable of improving the wear resistance of the sheet material, while it maintains the low frictional property thereof.

It is preferable that the mixing amount of the above-described powder serving as the lubricity-imparting material for 100 parts by weight of the non-injection-moldable UHMW PE resin is 0.5 to 5 parts by weight for the reason described below. When the mixing amount of the powder is less than 0.5 parts by weight, a desired low frictional property is not imparted to the sheet material. When the mixing amount of the powder is more than 5 parts by weight, there is a fear that the wear resistance of the sheet material deteriorates.

The sheet material is superior in the stability of the low frictional property by using at least one of the three kinds of powder having an average particle diameter of 1 to 30 μm. When the average particle diameter of the powder is smaller than 1 μm, there is a fear that uniform dispersibility of the powder deteriorates in producing the sheet material, which adversely affects the stability of the low frictional property of the sheet material. When the average particle diameter of the powder is larger than 30 μm, there is a fear that the strength of the sheet material lowers.

The thickness of the transfer charger 62 which is the sheet material is 0.04 mm to 1.0 mm. In this range of the thickness, the transfer charger 62 is capable of easily making a surface contact with the inner surface of the intermediate transfer belt 31. When the thickness of the sheet material is less than 0.04 mm, the sheet material is treated with low handleability. Thereby the failure rate is high in a work of bonding the sheet material and the pressing member 61 to each other. When the thickness of the sheet material is more than 1.0 mm, the sheet material has a low flexibility. Thereby the sheet material has a low degree of performance in the contact between the sheet material and the inner surface of the intermediate transfer belt 31.

The method of producing the transfer charger 62 which is the sheet material is as described below. Particles of the non-injection-moldable UHMW PE resin which is the base resin, the electrically conductive carbon, and at least one of the PTFE resin powder, the graphite powder, and the silicone resin powder serving as the lubricity-imparting material are weighed to form a uniform mixture. The uniform mixture is supplied to a molding die to perform compression molding including premolding, calcining, and molding to form a billet which is a molded material. The billet is mounted on a lathe to skive it.

In the above-described embodiment, the construction having four image-forming parts which form toner images of different colors is exemplified. The number of the image-forming parts is not limited to four, but a desired number of the image-forming parts may be set as necessary.

In the above-described embodiment, the laser printer is exemplified as the image-forming apparatus. The image-forming apparatus of the present invention is not limited to the laser printer, but it is possible to apply the present invention to other image-forming apparatuses such as a copying machine, a facsimile apparatus, and composite machines in which the functions of these image-forming apparatuses are combined. By applying the present invention to the transfer part of the other image-forming apparatuses, it is possible to obtain an effect similar to that as in the laser printer.

EXAMPLES

Materials used in examples and comparative examples are shown below.

(1) Non-injection-moldable UHMW PE resin-1: produced by Mitsui Chemicals, Inc., Hi-zex-million 240S, weight-average molecular weight: 2,000,000, average particle diameter measured by laser analysis method: 120 μm, different configurations (like Irish Cobbler potatoes)

(2) Non-injection-moldable UHMW PE resin-2: produced by Mitsui Chemicals, Inc., Hi-zex-million 240M, weight-average molecular weight; 2,400,000, average particle diameter measured by laser analysis method: 160 μm, different configurations (like Irish Cobbler potatoes)

(3) Carbon black: produced by Ketjenblack International Inc., Ketjenblack EC-600JD, primary particle diameter; 34 nm (average particle diameter measured by laser analysis method: not more than 0.5 μm), BET specific surface area: 1270 $m^2/g$ (4) PTFE resin powder: produced by Kitamura Co., Ltd., KTL-610, average particle diameter measured by laser analysis method: 12 μm (5) Graphite powder: produced by Timcal Graphite and Carbon Inc. TIMREX KS-25, fixed carbon: 99.9 wt %, average particle diameter measured by laser analysis method: 25 μm (6) Silicone resin powder: produced by Shin-Etsu Chemical Co., Ltd., KMP-590, average particle diameter measured by laser analysis method: 2 μm (7) Injection-moldable UHMW PE resin: produced by Mitsui Chemicals, Inc., Lubmer, weight-average molecular weight: 500,000

(8) Polyether ether ketone resin: Victrex plc., PEEK-450P

Example 1 Through 4 and Comparative Example 1

The materials were dry-blended at the mixing ratios shown in table 1 by using a Henschel dry mixer to obtain a mixture of each example and the comparative example 1. A pressure of 0.5 MPa was applied to the mixture by using a press machine to premold a cylindrical article having an outer diameter of ϕ122 mm, an inner diameter of ϕ64 mm, and a height of 100 mm. The article was calcined at 370° C. for five hours.

Figure 4:
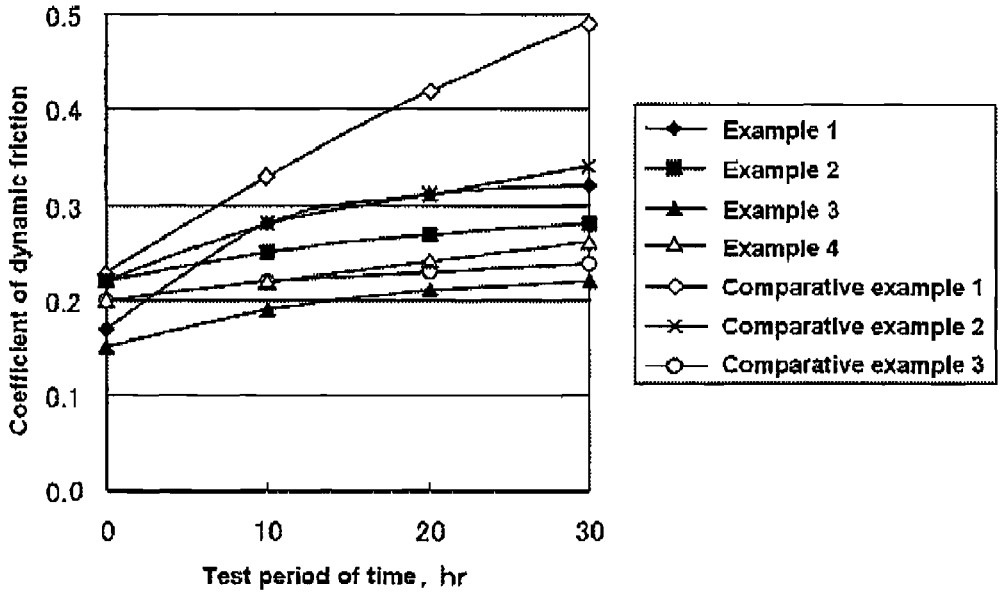
FIG. 4 shows a change of the friction coefficient of the transfer charger of the present invention with age.
Figure 5:
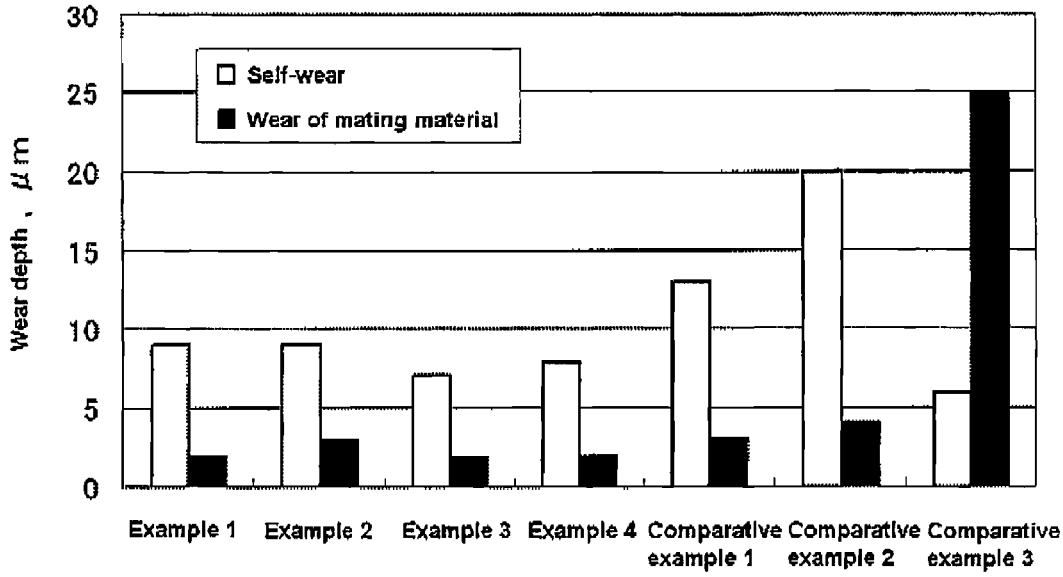
FIG. 5 shows a wear depth of the transfer charger of the present invention.
Figure 6A:
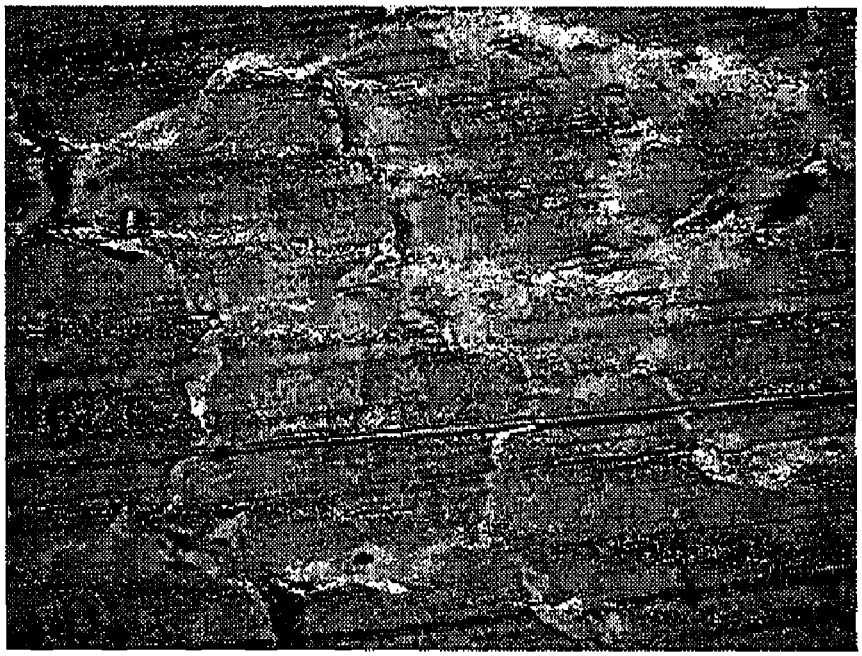
FIG. 6A shows an enlarged photograph of a surface of a sheet material of example 2.
Figure 6B:
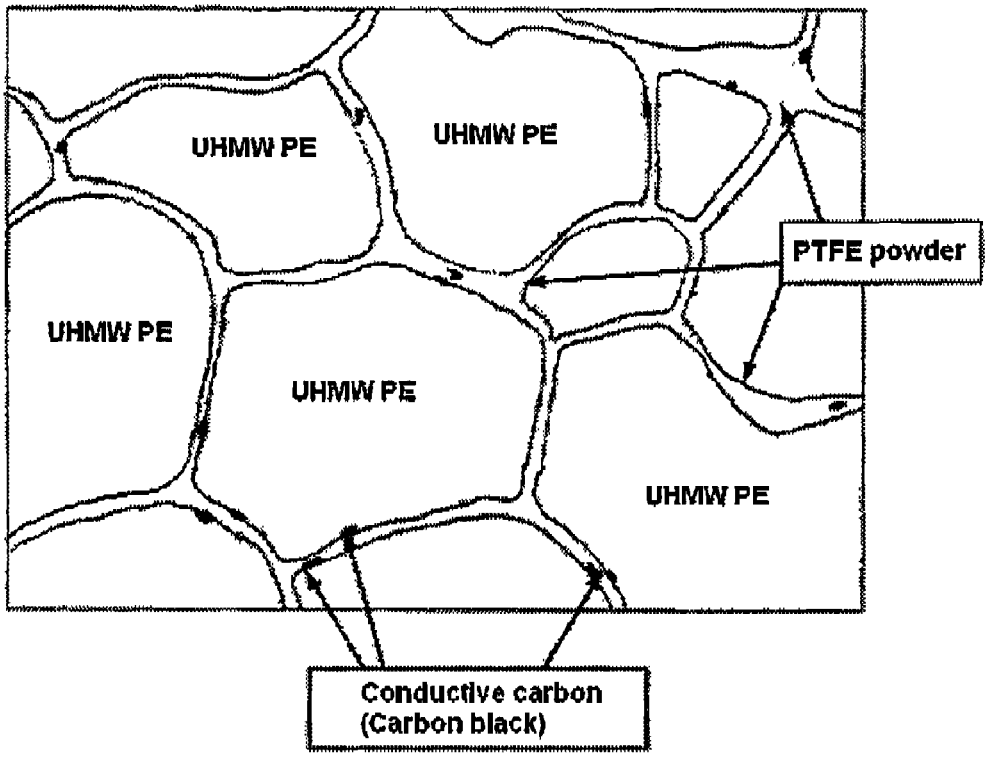
FIG. 6B is a diagram of the surface of the sheet material of example 2.

The calcined cylindrical article was skived to obtain a sheet material having a thickness of 0.2 mm. A specimen having 10 mm in its vertical length and 25 mm in its horizontal length was cut from the sheet material. The coefficient of dynamic friction and wear depth of each specimen were measured by a frictional wear test shown below. FIG. 4 shows the results of the coefficient of dynamic friction. FIG. 5 shows the results of the wear depth. The surface resistance value was measured in accordance with the method specified in JIS K7194. Table 1 shows the results of the surface resistance value. FIG. 6A shows a micrograph (×500) of the surface of the sheet material of the example 2.

Comparative Examples 2 and 3

The materials were dry-blended at the mixing ratios shown in table 1 by using the Henschel dry mixer to obtain a mixture of each comparative example. A pellet was produced from each mixture by using a biaxial melt extrusion machine. After the pellet was molded by injection molding into an article having a diameter of 40 mm and a length of 10 mm, the article was machined to obtain a specimen having a thickness of 0.2 mm, a vertical length of 10 mm, and a horizontal length of 25 mm. A frictional wear test was conducted on each specimen in a manner similar to that of the examples. The surface resistance value of each specimen was also measured. FIG. 4 shows the results of the coefficient of dynamic friction. FIG. 5 shows the results of the wear depth. Table 1 shows the results of the surface resistance value.

<Frictional Wear Test>

A frictional wear test was conducted by using a pin-on-disk type testing machine. Polybutylene naphthalate resin (material for intermediate transfer belt) was used as a mating material. The coefficient of dynamic friction of each specimen and the wear depth thereof immediately after the test finished were measured every 10 hours in a state (surface which contacted mating material: front end: ϕ5 mm×width: 10 mm) in which each specimen was bonded to the surface of a base material made of rubber. As the test conditions, a sliding speed: 30 m/minute, a surface pressure: 0.05 MPa, and a surface temperature of the mating material: 80° C. The test was conducted for 30 hours in the above-described conditions.

As shown in FIGS. 4 and 5 and table 1, the transfer charger which is the sheet material of the examples of the present invention had surface resistance values (JIS K7194) of $1.0\times10^{2}\Omega/\square$ to $1.0\times10^{12}\Omega/\square$. The transfer chargers were low in the initial friction coefficients and had a small change in the friction coefficients in the test operation performed for 30 hours. The transfer chargers had no problems in the wear resistances thereof. The friction coefficient of the transfer charger of the comparative example 1 not containing the lubricity-imparting material which is the essential component of the present invention became higher with the elapse of time than the friction coefficient of the transfer chargers of the examples. That is, the transfer charger of the comparative example 1 was unstable. In the transfer chargers of the comparative example 2 and 3 containing the resin different from the base resin of the transfer charger of the present invention which is the sheet material, the wear amount of the specimens or that of the mating material were three to nine times larger than those of the transfer chargers of the examples.

INDUSTRIAL APPLICABILITY

Because the transfer charger of the present invention is the sheet material consisting of the resin composition, it has a low and stable frictional resistance and is capable of stably contacting the intermediate transfer belt. Thus an image deviation does not occur. Therefore the transfer charger and the image-forming apparatus using the transfer charger can be preferably used.

| Explanation of letters or numerals | |
|---|---|
| 10 | process cartridge |
| 12 | photosensitive drum (image holder) |
| 13 | charging means |
| 14 | developing device |
| 15 | cleaning device |
| 20 | optical unit |
| 30 | intermediate transfer unit |
| 31 | intermediate transfer belt |
| 32, 33, 34 | driving rollers |
| 35 | power source |
| 36 | secondary transfer roller |
| 40 | recording material supply unit |
| 50 | fixing unit |
| 51 | fixing roller |
| 52 | pressure roller |

TABLE 1

| | Example | | | | Comparative example | | |
|---|---|---|---|---|---|---|---|
| | 1 | 2 | 3 | 4 | 1 | 2 | 3 |
| Components of resin composition and mixing amount thereof (part by weight) | | | | | | | |
| Non-injection-moldable UHMW PE resin-1 | 100 | 100 | 100 | — | 100 | — | — |
| Non-injection-moldable UHMW PE resin-2 | — | — | — | 100 | — | — | — |
| Conductive carbon | 2 | 5 | 15 | 3 | 3 | 5 | 5 |
| PTFE resin powder | 0 | 2 | 0 | 4 | 0 | 2 | 5 |
| Graphite powder | 0.5 | 0 | 0 | 0 | 0 | 0 | 0 |
| Silicone resin powder | 0 | 0 | 5 | 0 | 0 | 0 | 0 |
| Injection-moldable UHMW PE resin | — | — | — | — | — | 100 | — |
| Polyether ether ketone resin | — | — | — | — | — | — | 100 |
| Surface resistance value, Ω/□ | 5300 | 1900 | 500 | 2300 | 6400 | 2000 | 2300 |

-continued

| Explanation of letters or numerals | |
|---|---|
| 53 | discharge tray |
| 60 | primary transfer means |
| 61 | pressing member |
| 62 | transfer charger |
| 62a | contact surface |
| 62b | bonding surface |
| 63 | supporting member |
| 64 | compression spring |

What is claimed is:

1. A transfer charger which is mounted inside an image-forming apparatus where a toner image held on an image holder is transferred to an intermediate transfer belt to obtain an image, said transfer charger making a surface contact with an inner surface of said intermediate transfer belt opposite to a transfer surface thereof to which said toner image is transferred, with said transfer charger being pressed toward said image holder, owing to a pressing member, said transfer charger being a sheet material consisting of a resin composition containing 100 parts by weight of non-injection-moldable ultra-high-molecular-weight polyethylene resin, 2 to 15 parts by weight of electrically conductive carbon, and 0.5 to 5 parts by weight of at least one kind of powder selected from among polytetrafluoroethylene resin powder, graphite powder, and silicone resin powder.

2. The transfer charger according to claim 1, wherein said non-injection-moldable polyethylene resin is ultra-high-molecular-weight polyethylene resin having a weight-average molecular weight of 1,000,000 to 4,000,000.

3. The transfer charger according to claim 1, wherein particles of said non-injection-moldable ultra-high-molecular-weight polyethylene resin are unspherical.

4. The transfer charger according to claim 1, wherein an average particle diameter of said non-injection-moldable ultra-high-molecular-weight polyethylene resin is not less than three times as large as an average particle diameter of said electrically conductive carbon and an average particle diameter of each of said selected kinds of powder.

5. The transfer charger according to claim 1, wherein an average particle diameter of said non-injection-moldable ultra-high-molecular-weight polyethylene resin is 100 to 200 μm; an average particle diameter of said electrically conductive carbon is not more than 1 μm; and an average particle diameter of each of said selected kinds of powder is 1 to 30 μm.

6. The transfer charger according to claim 1, wherein said electrically conductive carbon is Ketjenblack.

7. The transfer charger according to claim 6, wherein a primary particle diameter of said Ketjenblack is 30 to 38 nm.

8. The transfer charger according to claim 6, wherein said Ketjenblack has a BET specific surface area of 1000 to 1500 $m^2/g$.

9. The transfer charger according to claim 1, wherein said polytetrafluoroethylene resin powder is modified polytetrafluoroethylene resin powder modified with alkyl vinyl ether.

10. The transfer charger according to claim 1, wherein said graphite powder is artificial graphite containing not less than 98.5 wt % of fixed carbon.

11. The transfer charger according to claim 1, wherein said silicone resin powder is spherical.

12. The transfer charger according to claim 1, having a surface resistance value (JIS K7194) of $1.0\times10^2\Omega/\square$ to $1.0\times10^{12}\Omega/\square$.

13. The transfer charger according to claim 1, having a sheet thickness of 0.04 mm to 1.0 mm.

14. The transfer charger according to claim 1, containing said electrically conductive carbon and said selected kinds of powder disposed at a grain boundary of particles of said non-injection-moldable ultra-high-molecular-weight polyethylene resin in a surface layer thereof.

15. An image-forming apparatus comprising an image holder holding a toner image; an intermediate transfer belt moving in contact with said image holder; a transfer charger for transferring said toner image held on said image holder to a surface of said intermediate transfer belt; and a pressing member for bringing said transfer charger into contact with an inner surface of said intermediate transfer belt opposite to a transfer surface thereof to which said toner image is transferred and pressing said transfer charger toward said image holder, wherein said transfer charger is as claimed in claim 1.

16. The image-forming apparatus according to claim 15, wherein said pressing member consists of rubber, elastomer or sponge.

* * * * *